US006904774B2

(12) United States Patent
Morita

(10) Patent No.: US 6,904,774 B2
(45) Date of Patent: Jun. 14, 2005

(54) COMPOSITE NEEDS

(75) Inventor: Toshiaki Morita, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 164 days.

(21) Appl. No.: 10/399,469

(22) PCT Filed: Oct. 15, 2001

(86) PCT No.: PCT/JP01/09057

§ 371 (c)(1),
(2), (4) Date: Apr. 18, 2003

(87) PCT Pub. No.: WO02/34985

PCT Pub. Date: May 2, 2002

(65) Prior Publication Data

US 2004/0093909 A1 May 20, 2004

(30) Foreign Application Priority Data

Oct. 20, 2000 (JP) ..... 2000-321088

(51) Int. Cl.[7] ..... D04B 35/06
(52) U.S. Cl. ..... 66/120
(58) Field of Search ..... 66/116, 120, 121, 66/123

(56) References Cited

U.S. PATENT DOCUMENTS 1,364,088 A * 1/1921 Ray ..... 66/13
1,461,007 A * 7/1923 Taft ..... 66/120
5,275,023 A * 1/1994 Schindler ..... 66/120
6,389,848 B1 * 5/2002 Kyoutani ..... 66/120
6,568,223 B1 * 5/2003 Morita ..... 66/120
6,598,430 B2 * 7/2003 Ruoff et al. ..... 66/120

FOREIGN PATENT DOCUMENTS

| | | |
|---|---|---|
| DE | 19950259 C1 | 1/2001 |
| JP | 48-42161 A | 6/1973 |
| JP | 1-54459 B | 11/1989 |
| JP | 7-197359 A | 8/1995 |
| WO | WO 00/71796 A1 | 11/2000 |

* cited by examiner

*Primary Examiner*—Danny Worrell
(74) *Attorney, Agent, or Firm*—Rothwell, Figg, Ernst & Manbeck, P.C.

(57) ABSTRACT

A tongue (67) is provided, at a front end thereof, with a drop-loop preventing step (79), and the hook (11) is provided, on an outer edge portion thereof extending from a sharp-pointed tip (27) of the hook to a top (29) of the hook, with a loop escape surface (31) to hide the drop-loop preventing step (79) when the hook (11) is closed by the tongue (67). In addition, the front end of the tongue is lowered so that a height between a bottom of the needle body and a top of the drop-loop preventing step (79) is lowered more when the slider is in a knock-over position than before the slider arrives at the knock-over position and also the top of the drop-loop preventing step (79) positioned at the knocked-over position can be positioned at a lower level than the top (29) of the hook. This can allow can allow a further smooth knock-over of the loop without negative effects on the yarn feed requirements for the capture of the yarn by the needle hook.

5 Claims, 5 Drawing Sheets

3A

3B

5A

5B

5C

5D

5E

COMPOSITE NEEDS

This application is a 35 USC §371 National Phase Entry Application from PCT/JP01/09057, filed Oct. 15, 2001, and designating the U.S.

TECHNICAL FIELD

The present invention relates to a compound needle used for knitting a knitted fabric, which comprises a needle body having a hook at a tip thereof and a slider having a tongue formed by two blades and in which the hook is opened and closed with the slider tongue by a relative movement between the needle body and the slider.

BACKGROUND ART

In general, when the compound needle is used to knit a knitted fabric such as a bubble stitch requiring an increased number of knitting yarns for forming a single loop (stitch), the loop is held on the slider tongue of the compound needle repeatedly several times. The loop retained on the slider tongue sometimes slips off therefrom to cause knitting faults. The slippage of the loop from the end of the slider tongue into the hook before the loop is knocked over presents problems for knitting stitches, not peculiar to the bubble stitch.

There was proposed a compound needle wherein the slider tongue is provided, at a front end thereof, with a small projection, to provide a hard slippage of the loop before knocked over (Japanese Patent Publication No. Hei 1(1989)-54459). The small projection provides the advantage of well holding the loop on the slider tongue, while on the other hand, it provides the disadvantage of providing a hard release of the loop from the slider tongue to hinder the loop from being knocked over.

In the light of this disadvantage, the applicant of this application previously proposed an improved compound needle in International Patent Application No. PCT/JP00-03127. In that compound needle, the slider tongue is provided, at a front end thereof, with a drop-loop-preventing step to prevent a loop held on the tongue from slipping off therefrom during knitting and also the hook is provided, on an outer edge portion thereof extending from a front end of the hook toward a top thereof, with a loop escape surface of a gentle slant, such that when the hook is closed by the tongue, the drop-loop-preventing step is covered by the loop escape surface to facilitate release (knock-over) of the loop formed.

It is an object of the present invention to provide a further improved compound needle of a knitting machine by making improvements on the compound needle described in International Patent Application No. PCT/JP00-03127 in such a manner that the loop can be well prevented from slipping off from the front end of the slider tongue into the hook until it is knocked over and also can be released therefrom further smoothly when it is knocked over.

It is another object of the present invention to provide a compound needle of a knitting machine that can allow a further smooth knock-over of the loop without negative effects on the yarn feed requirements for the capture of the yarn fed to the needle by the hook.

DISCLOSURE OF THE INVENTION

The present invention provides a compound needle used for a knitting machine comprising a needle body having a hook at a front end thereof and a slider having a tongue formed by two blades, the slider being supported on the needle body to be freely advanced and retracted along a surface of the needle body serving as a supporting surface so that the needle hook can be opened and closed with the slider tongue by a relative movement between the needle body and the slider; the tongue being provided, at a front end thereof, with a drop-loop preventing step to prevent a loop retained on an upper edge of the tongue from slipping off from the front end of the tongue; and the hook being provided, on an outer edge portion thereof extending from a sharp-pointed tip of the hook to a top of the hook, with a loop escape surface to hide the drop-loop preventing step when the hook is closed by the tongue, wherein there is provided tongue lowering means for lowering the front end of the tongue so that a height between a bottom of the needle body and a top of the drop-loop preventing step is lowered more when the slider is in a knock-over position than before the slider arrives at the knock-over position and also the top of the drop-loop preventing step positioned at the knocked-over position can be positioned at a lower level than the top of the hook.

The tongue lowering means does not allow the lowering of the front end of the tongue at least until the loop retaining edge of the drop-loop preventing step provided at the front end of the tongue of the slider goes past the sharp-pointed tip of the hook.

The tongue lowering means include a cam surface formed on the supporting surface of the needle body for supporting thereon the blades of the slider.

The tongue lowering means is provided with biasing means for biasing lower surfaces of the blades of the slider against a blade supporting surface of the needle body so that the front end of the tongue can be lowered in accordance with a level of the cam surface provided in the needle body.

The compound needle may comprise tongue raising/lowering means for raising and lowering the front end of the tongue so that the height between the bottom of the needle body and the top of the drop-loop preventing step can be lowered most when the hook is fully opened; can be raised most when the knitting yarn is captured by the hook; and can be lowered more when the loop is knocked over than when the knitting yarn is captured, and also a height between the bottom of the needle body and the top of the drop-loop preventing step can be positioned at a lower level than a height between the bottom of the needle body and the top of the hook, for the knock-over of the loop.

According to the present invention, since the front end of the tongue is kept in its raised position until the knitting yarn fed is captured by the hook while being closed by the tongue, or until the slider arrives at the knock-over position, the yarn feed requirements for the capture of the yarn can be prevented from being complicated or worsened. After the knitting yarn fed is captured by closing the hook, the loop retained on the tongue is knocked over from the needle at the knock-over position. At the knock-over position, the drop-loop preventing step is hidden by the loop escape surface of the outer edge portion of the hook extending from the sharp-pointed tip of the hook to the top of the hook and also the tongue is lowered so that the top of the drop-loop preventing step can be positioned at a lower level than the top of the hook by the tongue lowering means. Since the top of the drop-loop preventing step is positioned at a lower level, when the loop is moved over the top of the hook, a reduced contact area between the loop and the needle is provided and thus a frictional resistance to the loop to be knocked over is reduced to that extent, and as such can allow the smooth knock-over of the loop.

When the slider is positioned in its most retracted position and the hook is fully opened, the top of the drop-loop preventing step is positioned at a lowest level. During the time during which the slider is advanced from that position to capture the knitting yarn by the hook and the hook is closed, the front end of the tongue is raised and positioned at a highest level. When the loop is positioned at the knock-over position-after the hook is closed, the top of the drop-loop preventing step provided at the front end of the tongue is positioned at a lower level than the top of the bend of the hook. This can provide a reduced frictional resistance to the loop to be knocked over, and as such can allow the smooth knock-over of the loop. Also, when the hook is fully opened, the tongue can be positioned at a lower level, the vertical interval between the throat and cheek of the needle body can be reduced, in other words, the height of the tongue containing portion formed in the needle body can be reduced. This can provide the result that the frictional resistance to the loop retained on the needle body can be reduced and the load placed on the knitting yarn can be reduced.

BRIEF DESCRIPTION OF THE DRAWINGS

FIG. 3A illustrates the state of a needle hook just before being closed by a slider to form a loop and FIG. 3B illustrates the positional relationship between a needle body and the slider when the loop is knocked over.

BEST MODE FOR CARRYING OUT THE INVENTION

Figure 1:
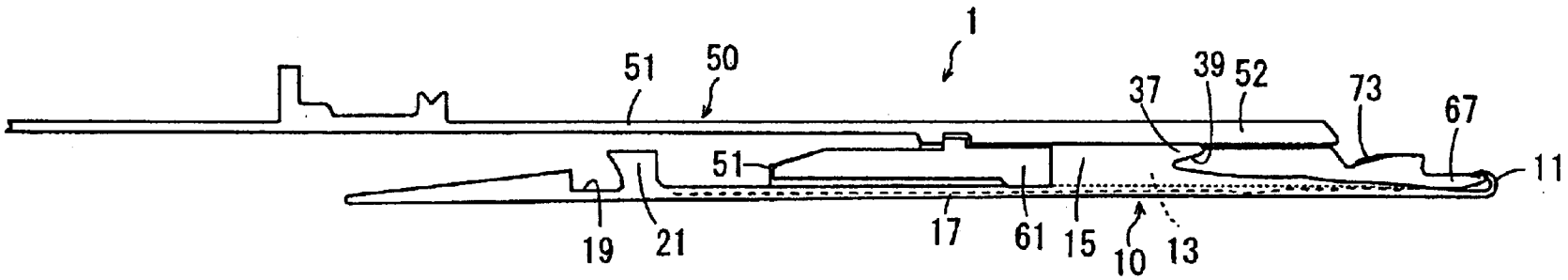
FIG. 1 illustrates a compound needle according to an embodiment of the present invention.
Figure 2:
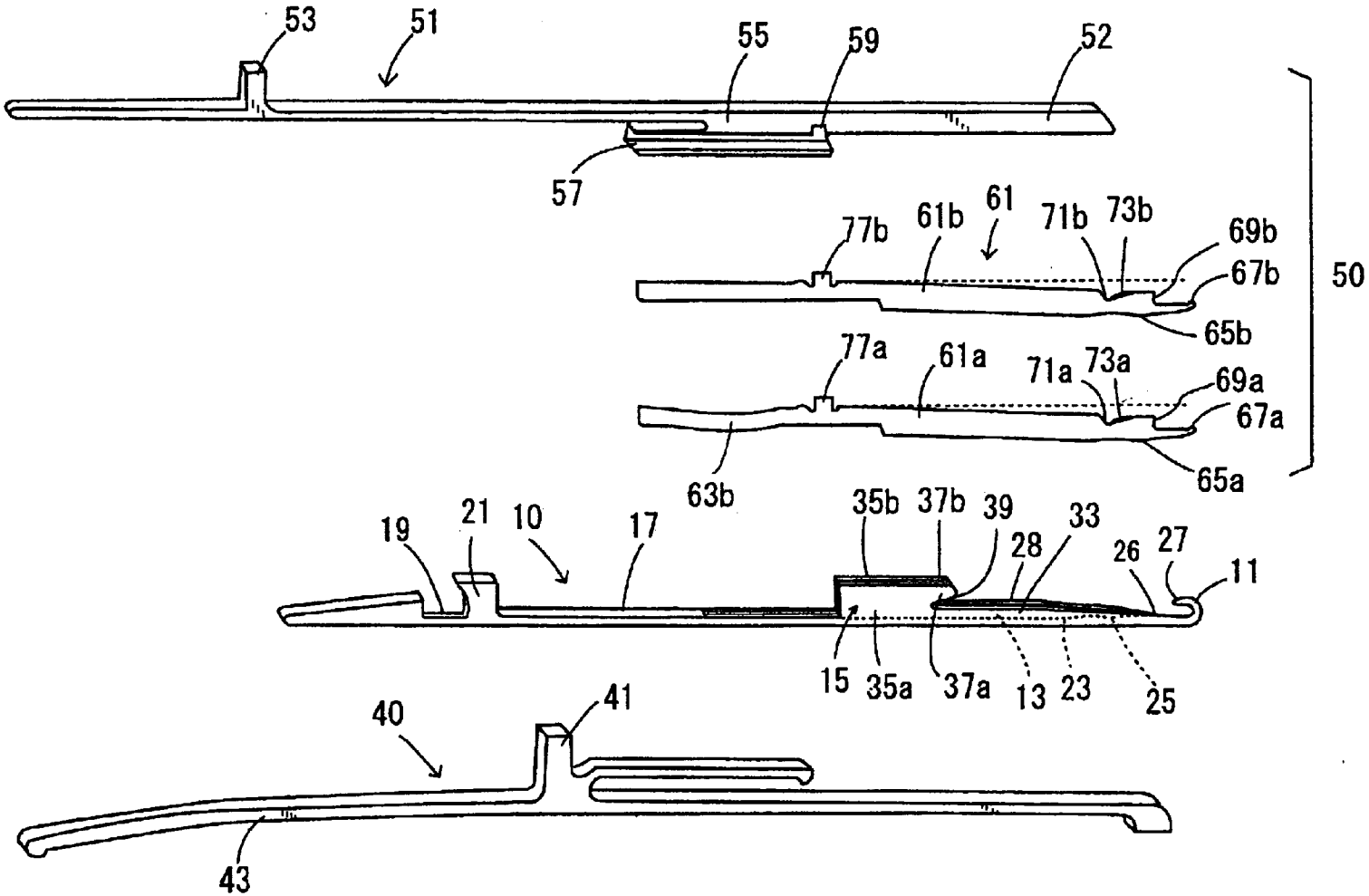
FIG. 2 illustrates parts of the compound needle.

A preferred embodiment of a compound needle of the present invention will be described below with reference to the accompanying drawings.

A compound needle 1 of an embodiment of the invention comprises a needle body 10 and a slider 50 to be slidably engaged in the needle body 10.

The needle body 10 includes a hook 11, a grooved portion 15 having a blade groove 13 formed to contain blades 61 of the slider 50, a center body portion 17 to support a lower arm 55 of a main body portion 51 of the slider 50, a recess 19 formed at a rear end portion of the needle body to be engaged with a front end portion of a jack 40, and a stopper 21 for limiting a rear end position of the slider 50. The blade groove 13 is formed so that it can contain front end portions of the blades therein when the slider 50 is in its retracted position with respect to the needle body 10. Also, the blade groove 13 has a cam surface 23 formed on a bottom thereof so that when the slider 50 is advanced, lower surfaces 65 of tongues of the slider blades formed at rear end portions thereof can be brought into engagement with the cam surface 23 to move the tongues upward and put them into abutment with an sharp-pointed tip 27 of the hook. The blade groove 13 has another cam surface 25, formed at a hook side thereof with respect to the cam surface 23, to allow the tongues 67 moved upward by the cam surface 23 to move downward when the hook is closed, as mentioned later. 26 denotes a throat and 28 denotes a cheek.

The needle body 10 and the jack 40 are formed to have thickness equal to each other and slightly smaller than a width of the needle groove. The jack 40 has at a center portion thereof a control butt 41 projected therefrom to engage with a cam provided at a cam carriage (not shown) so that it can be moved back and forth to move the needle body 10 forwardly and backwardly. 43 denotes an elastic leg which is curved to put its tail portion into abutment with the bottom of the needle groove.

The needle body 10 has side walls 35 at rearward positions thereof with respect to the tongue containing portion 33 of the grooved portion 15, and the side walls 35 has forked portions 37*a*, 37*b* which are formed integrally therewith and are extended forwardly from upper portions thereof on the front side. The forked portions 37 have, on lower surfaces thereof, cam surfaces 39 which are extended rearward to engage with upper surfaces of inclined surfaces 73 formed in the blades 61.

The slider 50 comprises a slider body 51 and a blade 61 fixed to the slider body 51. The slider body 51 has a slider butt 53 formed on an upper edge of a tail portion thereof and a lower arm 55, branched from a lower edge thereof at a forward position of the slider butt 53, for supporting the blades. The lower arm 55 has a thin-walled portion 57 on its portion except the lower edge of the slider body. 59 denotes a bored portion formed between the lower arm 55 and the slider body 51.

Figure 3:
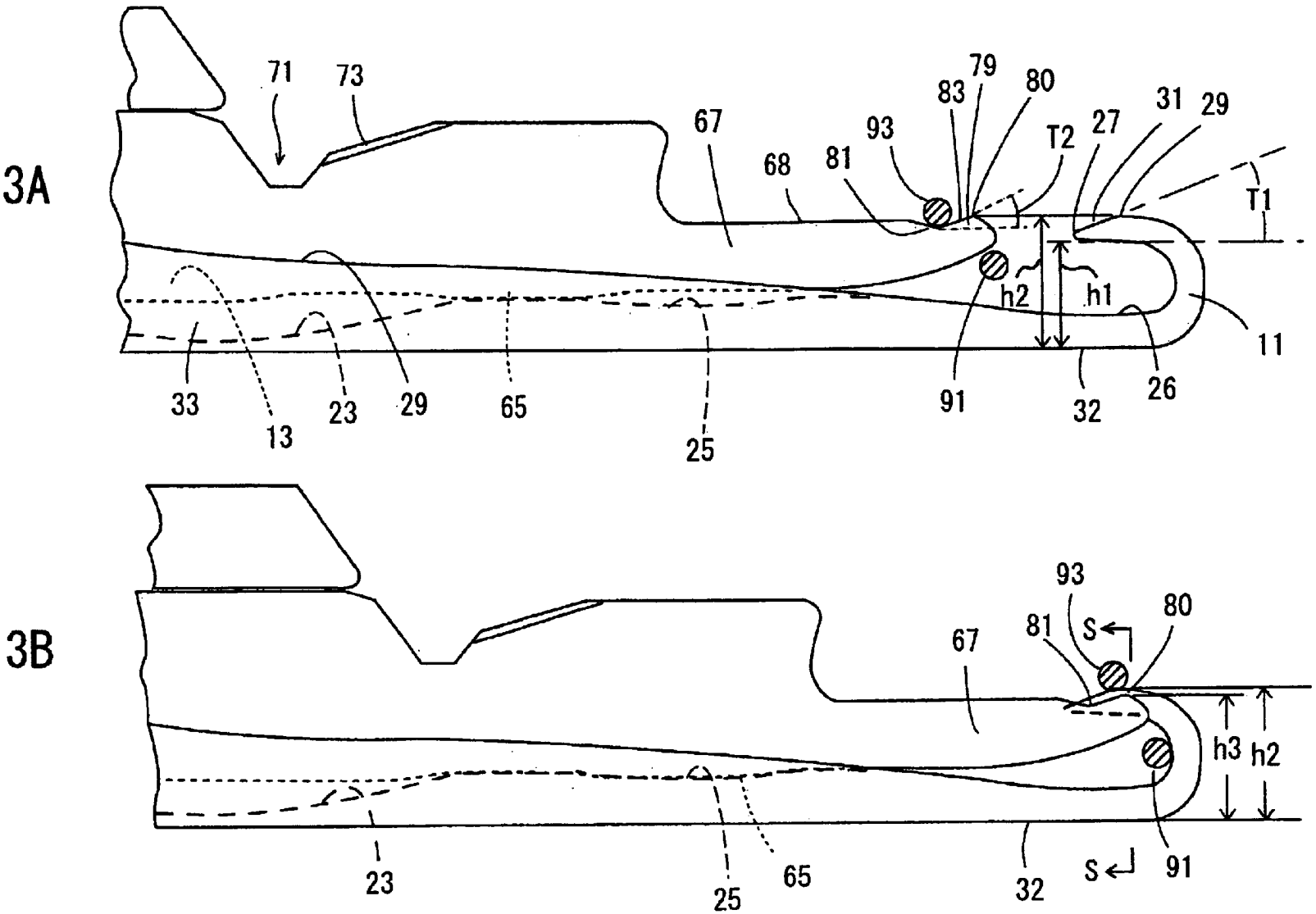
FIG. 3 is an enlarged view of a head portion of the compound needle.

The blade 61 comprising two combined thin plates 61*a*, 61*b* of symmetric and substantially identical shape is accommodated in the blade groove 13 of the needle body 10. The blades 61*a*, 61*b* have tongues 67*a*, 67*b* formed at front end portions thereof to abut with the sharp-pointed tip 27 of the hook. The blade 61 has shoulder portions 69*a*, 69*b* formed by raising rear end portions of the tongues 67*a*, 67*b* and recessed portions 71*a*, 72*b* formed at a rear side of the shoulder portions 69*a*, 69*b*. The recessed portions 71*a*, 71*b* has the inclined surfaces 73*a*, 73*b* formed at portions thereof on the side near the shoulder portions. The inclined surfaces 73*a*, 73*b* are curved toward side walls at the grooved portions on a side thereof on which they are slidably contacted with the side walls in such a manner that the upper surfaces of the inclined surfaces 73*a*, 73*b* are disposed to share a plane common with the cam surfaces of the forked portions 37*a*, 37*b*. 77 denotes a coupling portion for coupling the blade with the slider body 51 at the rear side of the blade groove 13. The front end portion 52 of the slider body extending forwardly is supported by the blade grooved portion 15 of the needle body 10. The tongues 67*a*, 67*b* are provided, on the tops at front ends thereof, with projections 79*a*, 79*b* serving as drop-loop preventing steps. 81 denotes a loop retaining edge formed on a base of the projection 79 (FIG. 3). Although the drop-loop preventing steps are provided in the form of protrusion formed at the front end portions of the tongues in the illustrated embodiment, they may alternatively be provided in the form of concave to hold the loop therein. In this alternation, the front end portion of the tongue forms a top of the drop-loop preventing step. The drop-loop preventing step (projection 79) may be provided in either of the tongues of the two blades.

After the blades are combined into one piece, a tail end portion of the blade 61 is brought into engagement with the thin-walled portion 57 of the lower arm 55 of the slider body 51 and the coupling portion 77 is fitted in the bored portion 59. Thereafter, the slider body 51 and the blade 61 are fixedly combined by crimping or equivalent. The blade 61 is configured so that when the blade 61 is in engagement with the blade groove 13 of the needle body 10, a front end portion of the blade 61 is biased so that the lower surface 65 of the front end portion of the blade 61 can put pressure upon the bottom of the blade groove 13 of the needle body 10 to some extent. FIG. 3 is an enlarged view of a head portion of the compound needle 1. FIG. 3A illustrates the state of the needle hook just before being closed to form a new loop after a knitting yarn 91 is fed to the compound needle 1. A loop 93 is a previously formed loop, which is retained on a loop retaining edge 81 of the tongue 67 and is prevented from slipping out by the projection 79. The blade 61 of the slider 50 (or the lower surfaces 65*a*, 65*b* of the blades) is slid over the cam surface 23 formed on the bottom of the blade groove 13 and is shifted up to a level where the front end of the tongue is abutted with the sharp-pointed tip 27 of the hook, as illustrated. As mentioned above, when the slider 50 is in engagement in the needle body 10, the lower surface 65 of the blade 61 at front end portion thereof is biased downward and pressed against the bottom of the blade groove 13. Due to this, when the slider 50 is moved close to or away from the hook 11, the blade 61 contacting with the bottom of the blade groove is shifted in level, so that the front end portion of the tongue is moved up and down.

An outer edge of the hook 11 extending from the sharp-pointed tip 27 of the hook 11 to the top 29 of the bend of the hook serves as a loop escape surface 31, and an upper edge of the projection 79 of the tongue 67 extending from the top 80 of the projection 79 to the upper edge 68 of the tongue serves as a loop retaining slant surface 83. An angle of inclination T1 of the loop escape surface 31 is made smaller than an angle of inclination T2 of the loop retaining slant surface 83. The angle of inclination T1 is set to an extent that can allow the loop 93 to easily go over the loop escape surface 31 of the hook so as to be knocked over. The loop retaining slant surface 83 is inclined so that it can prevent the loop 93 retained on the tongue 67 from slipping off easily from the front end of the tongue.

FIG. 3B illustrates the positional relationship between the needle body 10 and the slider 50 when the knitting yarn 91 is drawn in the hook 11 to form a new loop and the old loop 93 retained on the upper edge of the tongue (the loop in the previous course) is knocked over. As illustrated, when the top 80 of the projection 79 of the front end of the tongue moves close to the bottom 32 of the needle body, it takes a position lower than a height h2 between the bottom of the needle body and the top 29 of the bend of the hook. The way of shifting the projection 79 downward from the position of FIG. 3A to the position of FIG. 3B will be detailed later.

Figure 4:
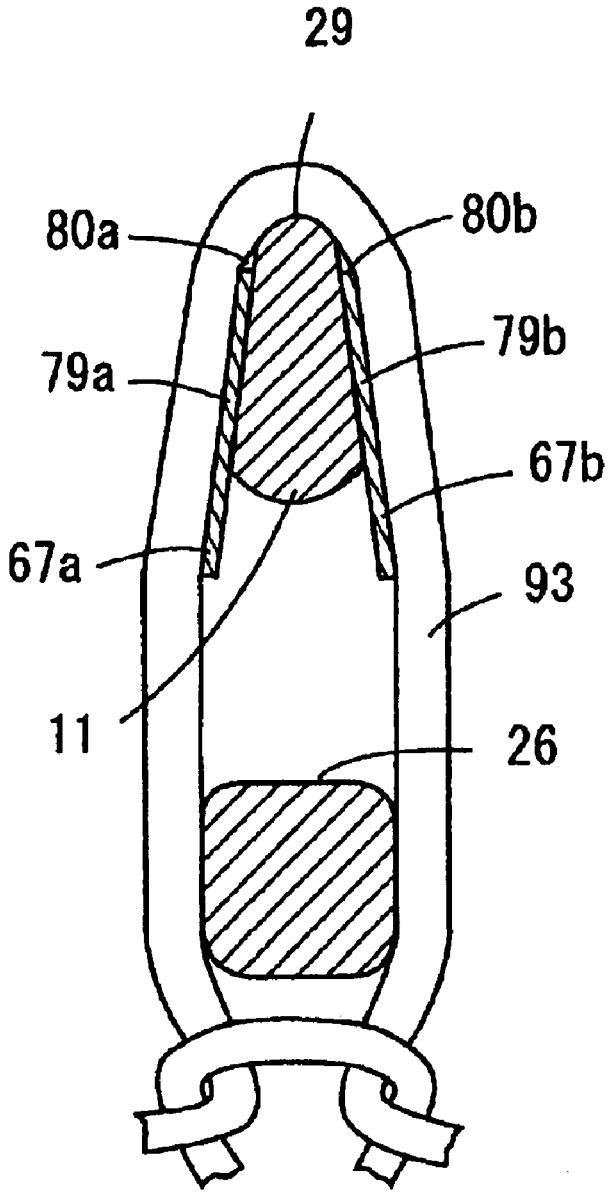
FIG. 4 is a sectional view taken along an arrowed line S—S of FIG. 3B, which illustrates the retained state of the loop just before knocked over.

The hook 11 is wedged between the two blades 61*a*, 61*b* of the slider 50, so that the sharp-pointed tip 27 of the hook 11 is held in sandwich relation between the tongues 67*a*, 67*b*. Then, the loop 93 retained on the loop retaining edge 81 is raised by the loop escape surface 31 of the hook 11 and disengaged from the projection 79 and then is moved over the top 29 of the bend of the hook 11 and knocked over. When the hook is closed (for the knock-over of the loop), the upper edge 68 of the slider tongue 67 is positioned at a lower level than the level of the sharp-pointed tip 27 of the hook 11, while also the top 29 of the bend of the hook 11 is positioned at a higher level than the top 80 of the projection 79. FIG. 4 is a sectional view taken along an arrowed line S—S of FIG. 3B. As seen from this figure, since the top 80 of the projection 79 is positioned at a lower level than the top 29 of the bend of the hook 11, the loop is smoothly knocked over from the needle with a reduced frictional resistance.

Now, operation of the compound needle thus constructed will be described. FIGS. 5A–5D are stepwise illustrations of relative movements between the needle body 10 and the slider 50 made when the needle hook 11 is closed. The loops and knitting yarn are omitted from the illustrations.

Figure 5:
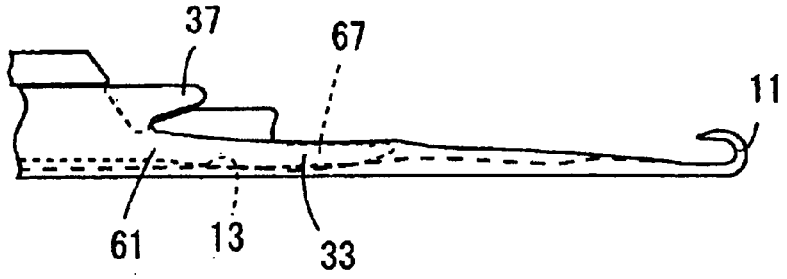
FIGS. 5A–5D of FIG. 5 are stepwise illustrations of relative movements between the needle body and the slider made when the needle hook is closed and FIG. 5E is an illustration of the positional relationship between the needle body and the slider when the loop is transferred.
Figure 5:
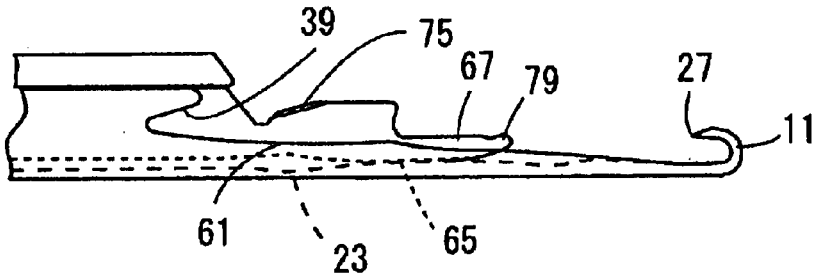
Figure 5:
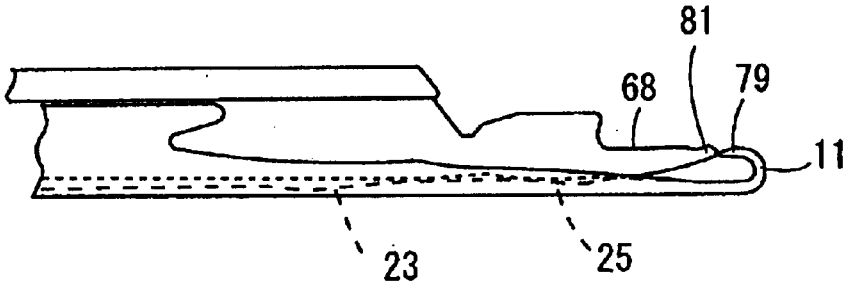
Figure 5:
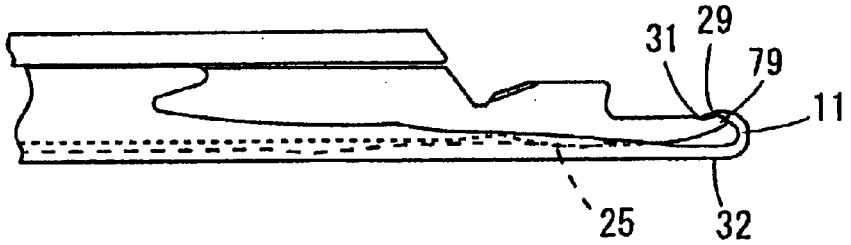
Figure 5:
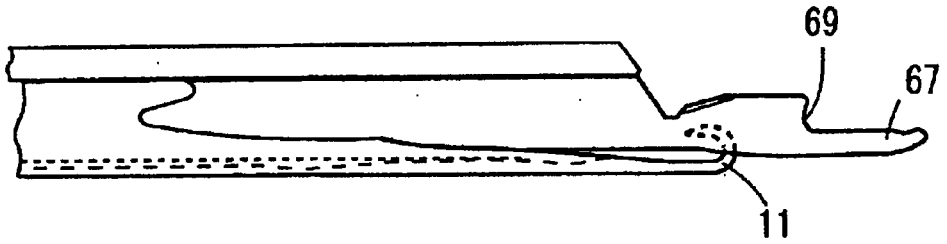

FIG. 5A illustrates the slider 50 located at its furthest retracted position with respect to the needle body 10. In this state, the tongue 67 is contained in the tongue containing portion 33 in the blade groove 13, so that the hook 11 is fully opened.

FIG. 5B illustrates the slider 50 moved to a position slightly advanced from the position of FIG. 5A toward the hook 11. In this state, the lower surface 65 of the blade 61 is engaged with the cam surface 3 of the slider groove 13 and thereby the tongue 67 of the slider is shifted to a raised position. The shifting of the slider tongue 67 to a raised position is associated with the elastic deformation of the blade itself.

FIG. 5C illustrates the slider 50 moved to a position where the projection 79 formed at the front end of the tongue of the slider 50 abuts with the sharp-pointed tip 27 of the hook. The raised position of the slider tongue is maintained until the loop retaining edge 81 passes the sharp-pointed tip 27 of the hook. A vertical interval between the loop retaining edge 81 and the sharp-pointed tip 27 of the hook is set to an extent that can allow the loop to be surely guided to the loop escape surface 31, without being caught by the sharp-pointed tip 27 of the hook, allowing for a tolerance in the production of the needle and a deflection of the blade resulting from the load applied from the loop retained on the upper edge of the slider tongue. After the loop goes past the sharp-pointed tip 27 of the hook, the front end of the tongue 67 is shifted to a lowered position with forward movement of the blade 61 along a downward slant surface of the cam surface 25 formed in the blade groove 13 of the needle body 10.

FIG. 5D illustrates the slider 50 moved further forward from the position of FIG. 5C to a knock-over position where the hook is completely closed. FIG. 5D illustrates the positional relationship between the needle body 10 and the slider 50 when the knitting yarn 91 fed is drawn in the hook 11 to form a new loop and the old loop retained on the upper edge of the tongue (the loop in the previous course) is knocked over (which corresponds to the positional relationship of FIG. 3B). As seen from the figure, the front end of the tongue is declined and the top 80 of the projection 79 is moved close to the bottom 32 of the needle body and positioned at a lower level than the top 29 of the bend of the hook.

As mentioned above, the front end portion of the tongue of the slider 50 is kept in its raised position without being declined until the loop retaining edge 81 goes past the sharp-pointed tip 27 of the hook and, then, it is declined for an interval of time from after the loop retaining edge 81 goes past the sharp-pointed tip 27 of the hook until it arrives at the knock-over position. This can ensure that the loop retained on the tongue 67 is guided to the loop escape surface 31 of the hook 11. Further, since the front end of the tongue is kept in its raised position during an interval of time during which the hook is closed to capture the knitting yarn, as mentioned above, the problem that the front end of the tongue pricks the knitting yarn and the like problem can be avoided, thus exerting no negative effects on the knitting yarn fed to the needle. In the case of a latch needle, since the knitting yarn is pushed in to the hook by a latch turned when the hook is closed, the yarn feed requirements can be somewhat sweetened. In contrast to this, in the case of a compound needle, since the hook is opened and closed by forward and backward movement of the slider, it is an important aspect for the yarn feed that the hook is closed in the state in which the front end of the slider is positioned at a higher level than the hook, no matter how slightest.

FIG. 5E illustrates a compound needle of the type that can allow the tongue 67 to go past the hook and move further to its advanced position for transference of loop. In this advanced position, the tongues 67*a*, 67*b* are separated right and left by the hook 11 and the loop is pushed out by the shoulders 69*a*, 69*b*. The blade is raised with forward movement of the lower surfaces 65*a*, 65*b* of the blade along the slant surface of the cam surface 25, so that the tongue is returned to its raised position. Also, when the tongue advanced is positioned at the loop transference position, the lower surface of the blade at a rear side thereof with respect to the cam surface 65 is abutted with a flat portion of the groove extending between the cam surfaces 23 and 25 and thereby the tongue is kept in its raised position.

When the slider 50 is moved backward from the advanced position to the retracted position, the slider 50 is guided by following the same track as the track along which the slider 50 is guided when moved forward. Specifically, the slider 50 is retracted and guided to its original return position (FIG. 6A) with the lower surfaces 65 of the blades contacting with the bottom of the blade groove 13, while the blades are gradually released from their elastic deformation during that time. Even when the release of the blades from their elastic deformation is hindered by something like dust accumulated in the blade groove 13 and thereby the blades are not accommodated in the tongue containing portion 33 of the blade groove 13 completely, since slant surfaces 75*a*, 75*b* of the blade 61 are brought into engagement with guide surfaces 39*a*, 39*b* formed on the forked portions 37*a*, 37*b* of the needle body 10, the blades are forced to be pressed down in the tongue containing portion 33.

While in the illustrated embodiment, the blades are fixedly coupled with the slider body in such a way that the front end portion of the blade is biased downward so that the front end of the tongue can be raised or lowered in accordance with the level of the cam surface formed on the bottom of the blade groove, this way of fixing the blades to the slider body is not of indispensable. Any proper construction may be adopted for the fixture, as long as it can allow the front end portion of the blade to be always in contact with the cam surface during the time during which the slider and the needle body are moved relative to each other.

In the compound needle of the embodiment illustrated above, the height between the bottom of the needle body and the top of the drop-loop preventing step is lowered most when the hook is fully opened (FIG. 5A); is raised most when the knitting yarn is captured by the hook (FIGS. 5B, 5C); and is lowered somewhat more when the loop is knocked over (FIG. 5D) than when the knitting yarn is captured. This can provide the following results. Since the projection provided at the front end of the tongue is positioned at a lower level than the top of the bend of the hook in the knock-over position, the loop is slid more smoothly to that extent, and as such can allow the loop to be smoothly knocked over. Further, by allowing the tongue to be raised from and lowered into the tongue containing portion when the slider is advanced and retracted, the vertical interval between the throat 26 and cheek 28 of the needle body 10 can be reduced. This can provide the result that when the needle is advanced and retracted, the frictional resistance to the loop retained on the needle can be reduced and the load placed on the knitting yarn can be reduced, thus providing improved yarn feed requirements. This can allow the knitting of a knitted fabric of tight stitch.

While in the embodiment illustrated above, the part of the bottom of the groove extending between the cam surface 23 and cam surface 25 formed in the blade groove is flattened, that part may be protruded in the form of a gentle slope. This enables the front end of the tongue to be positioned at a higher level when raised, and as such can provide further improved yarn feed requirements. In addition, the provision of the tongue lowering means for lowering the tongue enables the drop-loop preventing step having a larger vertical interval than the conventional drop-loop preventing step to be arranged at the front end of the tongue. This enables the number of times for e.g. tuck stitch of the bubble stitch can be increased.

While preferred embodiments of the invention have been illustrated above, it is needless to say that the present invention is not limited thereto but may practically be embodied variously within the sprit and scope of the present invention.

What is claimed is:

1. A compound needle used for a knitting machine comprising a needle body having a hook at a front end thereof and a slider having a tongue formed by two blades, the slider being supported on the needle body to be freely advanced and retracted along a surface of the needle body serving as a supporting surface so that the needle hook can be opened and closed with the slider tongue by a relative movement between the needle body and the slider; the tongue being provided, at a front end thereof, with a drop-loop preventing step to prevent a loop retained on an upper edge of the tongue from slipping off from the front end of the tongue; and the hook being provided, on an outer edge portion thereof extending from a sharp-pointed tip of the hook to a top of the hook, with a loop escape surface to hide the drop-loop preventing step when the hook is closed by the tongue, wherein there is provided tongue lowering means for lowering the front end of the tongue so that a height between a bottom of the needle body and a top of the drop-loop preventing step is lowered more when the slider is in a knock-over position than before the slider arrives at the knock-over position and also the top of the drop-loop preventing step positioned at the knocked-over position can be positioned at a lower level than the top of the hook.

2. The compound needle according to claim 1, wherein the tongue lowering means does not allow the lowering of the front end of the tongue at least until the loop retaining edge of the drop-loop preventing step provided at the front end of the tongue of the slider goes past the sharp-pointed tip of the hook.

3. The compound needle according to claim 1, wherein the tongue lowering means includes a cam surface formed on the supporting surface of the needle body for supporting thereon the blades of the slider.

4. The compound needle according to claim 3, wherein the tongue lowering means is provided with biasing means for biasing lower surfaces of the blades of the slider against a blade supporting surface of the needle body so that the front end of the tongue can be lowered in accordance with a level of the cam surface provided in the needle body.

5. The compound needle according to claim 1, wherein there is provided tongue raising/lowering means for raising and lowering the front end of the tongue so that the height between the bottom of the needle body and the top of the drop-loop preventing step can be lowered most when the hook is fully opened; can be raised most when the knitting yarn is captured by the hook; and can be lowered more when the loop is knocked over than when the knitting yarn is captured, and also a height between the bottom of the needle body and the top of the drop-loop preventing step can be positioned at a lower level than a height between the bottom of the needle body and the top of the hook, for the knock-over of the loop.

* * * * *

UNITED STATES PATENT AND TRADEMARK OFFICE

CERTIFICATE OF CORRECTION

PATENT NO. : 6,904,774 B2
DATED : June 14, 2005
INVENTOR(S) : Toshiaki Morita

It is certified that error appears in the above-identified patent and that said Letters Patent is hereby corrected as shown below:

Title page,
Item [54], Title, should read -- COMPOUND NEEDLE --.

Signed and Sealed this

Sixteenth Day of August, 2005

JON W. DUDAS
*Director of the United States Patent and Trademark Office*